US010172203B2

(12) United States Patent
Harada et al.

(10) Patent No.: US 10,172,203 B2
(45) Date of Patent: Jan. 1, 2019

(54) LIGHTING APPARATUS

(71) Applicant: PANASONIC INTELLECTUAL PROPERTY MANAGEMENT CO., LTD., Osaka (JP)

(72) Inventors: Kazuki Harada, Osaka (JP); Yoko Matsubayashi, Osaka (JP); Youji Tachino, Nara (JP); Makoto Yamada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/874,454

(22) Filed: Jan. 18, 2018

(65) Prior Publication Data

US 2018/0213623 A1 Jul. 26, 2018

(30) Foreign Application Priority Data

Jan. 25, 2017 (JP) ..... 2017-011723

(51) Int. Cl.

| | |
|---|---|
| ***H05B 37/02*** | (2006.01) |
| ***H05B 33/08*** | (2006.01) |
| ***F21V 5/00*** | (2018.01) |
| *F21Y 105/18* | (2016.01) |
| *F21V 3/02* | (2006.01) |
| *F21S 8/04* | (2006.01) |
| *F21V 7/22* | (2018.01) |

(Continued)

(52) U.S. Cl.

CPC ..... *H05B 33/0845* (2013.01); *F21V 5/007* (2013.01); *F21S 8/04* (2013.01); *F21V 3/02* (2013.01); *F21V 7/22* (2013.01); *F21V 19/0015* (2013.01); *F21Y 2105/18* (2016.08); *F21Y 2115/10* (2016.08)

(58) Field of Classification Search

CPC .. H05B 41/28; H05B 41/295; H05B 41/2827; H05B 41/3925; H05B 33/0815; H05B 33/0818; H05B 41/2828; H05B 41/3921; H05B 41/3927; H05B 37/029; H05B 33/0803; H05B 37/0254; H05B 37/02; Y02B 20/202

See application file for complete search history.

(56) References Cited

U.S. PATENT DOCUMENTS

| | | | | |
|---|---|---|---|---|
| 5,770,917 | A | 6/1998 | Yano et al. | |
| 2013/0020955 | A1* | 1/2013 | Igaki et al. | H05B 37/02 315/201 |
| 2014/0292213 | A1* | 10/2014 | Yoon et al. | H05B 33/0821 315/192 |

FOREIGN PATENT DOCUMENTS

| | | | |
|---|---|---|---|
| JP | 04-137305 | A | 5/1992 |
| JP | 09-120797 | A | 5/1997 |

(Continued)

*Primary Examiner* — Minh D A

(74) *Attorney, Agent, or Firm* — Greenblum & Bernstein, P.L.C.

(57) ABSTRACT

A lighting apparatus includes first light emitting elements and second light emitting elements, and a control circuit. The first light emitting elements the second light emitting elements are dispersedly disposed in a predetermined region. The first light emitting elements are more densely disposed in a periphery portion than in a center portion of the predetermined region. The second light emitting elements are more densely disposed in the center portion than in the periphery portion of the predetermined region.

20 Claims, 8 Drawing Sheets

(51) Int. Cl.
*F21V 19/00* (2006.01)
*F21Y 115/10* (2016.01)

(56) References Cited

FOREIGN PATENT DOCUMENTS

| | | | |
|---|---|---|---|
| JP | 2003-237464 | A | 8/2003 |
| JP | 2005-302500 | A | 10/2005 |
| JP | 2014-75186 | A | 4/2014 |

* cited by examiner

FIG. 8

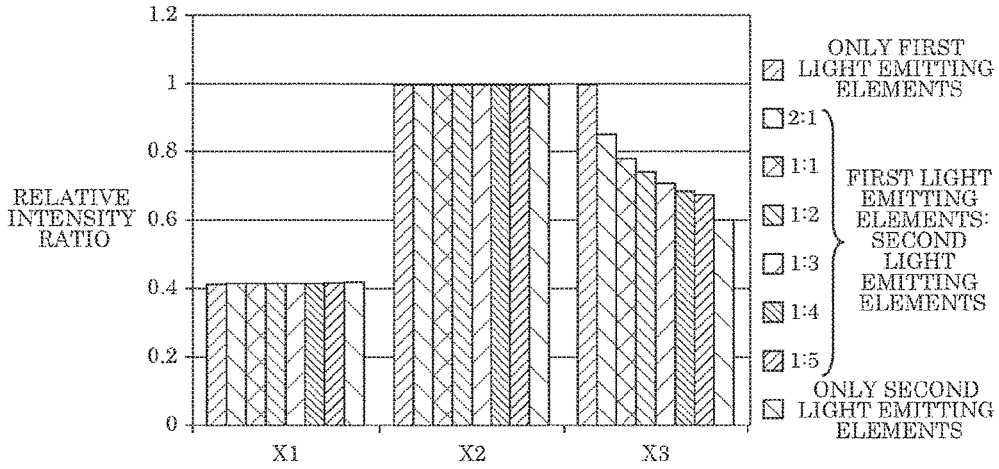

FIG. 9

| | CORRELATED COLOR TEMPERATURE [K] | Duv | Ra | FCI | FCI PERCENTAGE [%] | EFFICIENCY PERCENTAGE [%] | WHITISHNESS (CHROMA VALUE) |
|---|---|---|---|---|---|---|---|
| FIRST LIGHT EMITTING ELEMENTS | 6303 | 6.0 | 82 | 89 | 82 | 100 | 3.1 |
| SECOND LIGHT EMITTING ELEMENTS | 6536 | -0.3 | 94 | 109 | 100 | 75 | 2.0 |
| FIRST LIGHT EMITTING ELEMENTS:SECOND LIGHT EMITTING ELEMENTS = 2:1 | 6392 | 3.4 | 90 | 98 | 90 | 92 | 2.1 |
| FIRST LIGHT EMITTING ELEMENTS:SECOND LIGHT EMITTING ELEMENTS = 1:1 | 6398 | 3.2 | 91 | 98 | 90 | 88 | 2.1 |
| FIRST LIGHT EMITTING ELEMENTS:SECOND LIGHT EMITTING ELEMENTS = 1:2 | 6438 | 2.2 | 94 | 102 | 93 | 83 | 1.8 |
| FIRST LIGHT EMITTING ELEMENTS:SECOND LIGHT EMITTING ELEMENTS = 1:3 | 6460 | 1.6 | 95 | 103 | 95 | 81 | 1.7 |
| FIRST LIGHT EMITTING ELEMENTS:SECOND LIGHT EMITTING ELEMENTS = 1:4 | 6474 | 1.2 | 95 | 104 | 96 | 80 | 1.8 |
| FIRST LIGHT EMITTING ELEMENTS:SECOND LIGHT EMITTING ELEMENTS = 1:5 | 6484 | 1.0 | 95 | 105 | 97 | 79 | 1.8 |

| | CORRELATED COLOR TEMPERATURE [K] | Duv | Ra | FCI | FCI PERCENTAGE [%] | EFFICIENCY PERCENTAGE [%] | WHITISHNESS (CHROMA VALUE) |
|---|---|---|---|---|---|---|---|
| THIRD LIGHT EMITTING ELEMENTS | 2419 | 2.0 | 94 | 125 | - | - | 12.9 |
| TEST 1 | 6160 | 5.3 | 82 | 91 | 82 | 100 | 2.7 |
| TEST 2 | 6152 | 0.4 | 95 | 106 | 95 | 83 | 0.4 |
| TEST 3 | 6177 | -1.6 | 93 | 111 | 100 | 76 | 1.5 |

LIGHTING APPARATUS

CROSS REFERENCE TO RELATED APPLICATION

This application claims the benefit of priority of Japanese Patent Application Number 2017-011723 filed on Jan. 25, 2017, the entire content of which is hereby incorporated by reference.

BACKGROUND

1. Technical Field

The present disclosure relates to a lighting apparatus, and in particular to a lighting apparatus for correcting a change in visual performance due to aging.

2. Description of the Related Art

With the arrival of an aging society, there has been a great demand for a comfortable environment for old aged people (middle aged generation and over). In particular, improvement of visual environment achieved by lighting is an urgent issue. As such, it is thus necessary to clarify how lighting can correct a change in human visual system caused by aging. Examples of a change in visual performance due to aging mainly include (a) a fall in transmittance of a crystalline lens, in particular a fall in transmittance of a crystalline lens in a short wavelength range, and (b) a bleary eye (intraocular scattering) due to a cataract (a crystalline lens clouding over).

In order to address (a), lighting which increases a proportion of blue light that reaches a retina by intensifying light in a wavelength range where a transmittance of a crystalline lens falls, or in other words, by causing light to have a so-called high color temperature is recommended for old aged people, as disclosed in Japanese Unexamined Patent Application Publication No. 2003-237464.

Furthermore, there is a method of intensifying blue light components in order to take also (b) into consideration, as disclosed in Japanese Unexamined Patent Application Publication No. H04-137305. Japanese Unexamined Patent Application Publication No. H04-137305 recommends lighting which reduces glare by mainly reducing light in a wavelength range (of at least 470 nm and at most 530 nm) which has strong influence on glare, and thus yields advantageous effects of allowing users to perceive high contrast, high luminosity, and high color saturation.

Taking (b) into consideration, there is also a method of adjusting a color-variable wall in order to reduce intraocular scattering due to ambient light, as disclosed in Japanese Unexamined Patent Application Publication No. 2005-302500.

SUMMARY

Here, since it is regarded that the brightness necessary for old aged people to perform visual tasks is 2 to 5 times that for younger people, there has been a demand for a lighting apparatus which allows old aged people to perceive highly vivid colors while avoiding glare.

Furthermore, there has also been a demand for a lighting apparatus capable of emitting bright light over a wide area, in an area surrounding an area in which old aged people perform visual tasks.

In view of this, the present disclosure provides a lighting apparatus which prevents letters and observed objects from appearing to have lower readability and color saturation to old aged people, and emits bright light over a wide area.

A lighting apparatus according to an aspect of the disclosure includes first light emitting elements; second light emitting elements having chromaticity values in a same chromaticity range as the first light emitting elements; and a control circuit that controls the first light emitting elements and the second light emitting elements separately, wherein the first light emitting elements and the second light emitting elements are dispersedly disposed in a predetermined region, the first light emitting elements are more densely disposed in a periphery portion than in a center portion of the predetermined region, and the second light emitting elements are more densely disposed in the center portion than in the periphery portion of the predetermined region.

According to the present disclosure, letters and observed objects are prevented from appearing to have lower readability and color saturation to old aged people, and bright light is emitted over a wide area.

BRIEF DESCRIPTION OF DRAWINGS

The figures depict one or more implementations in accordance with the present teaching, by way of examples only, not by way of limitations. In the figures, like reference numerals refer to the same or similar elements.

FIG. 8 is a graph illustrating relative intensity ratios at a first value and a third value of spectral distributions of light emitted by the light emitting elements having the ratios in number according to the embodiment, when the relative intensities at a second value are 1;

FIG. 9 is a table illustrating optical characteristics of the entire lighting apparatus at the ratios in number of the first light emitting elements to the second light emitting elements to the third light emitting elements according to the embodiment;

DETAILED DESCRIPTION OF THE EMBODIMENT

Figure 1:
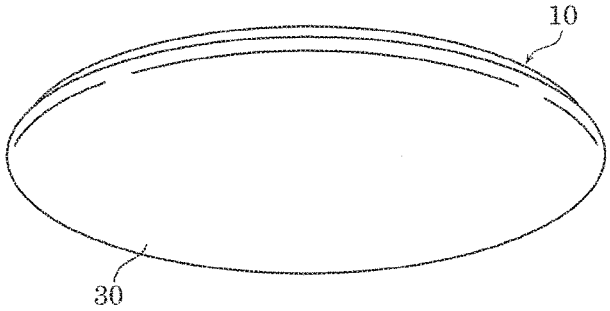
FIG. 1 is a perspective view of a lighting apparatus according to an embodiment.

Hereinafter, exemplary embodiments of the present disclosure will be described with reference to the drawings. The embodiments described below each show a specific example of the present disclosure. Therefore, numerical values, shapes, materials, elements, the arrangement and connection of the elements, and others indicated in the following embodiments are mere examples, and therefore are not intended to limit the present disclosure. Thus, among the elements in the following embodiments, elements not recited in any independent claim defining the most generic concept are described as arbitrary elements.

Furthermore, the term "approximately", described here using "approximately the same" as an example, is intended to include not only that which is exactly the same but also that which is acknowledged to be substantially the same. Furthermore, the same is true for the term "vicinity".

It should be noted that the drawings are schematic diagrams, and do not necessarily provide strictly accurate illustration. Furthermore, in the drawings, substantially identical components are assigned the same reference signs, and overlapping description is omitted or simplified.

The following describes a lighting apparatus according to exemplary embodiments of the present disclosure.

Embodiment

[Configuration]

First, the configuration of lighting apparatus 10 according to this embodiment will be described using FIG. 1 to FIG. 3.

FIG. 1 is a perspective view of lighting apparatus 10 according to this embodiment. FIG. 2 is an exploded perspective view of lighting apparatus 10 according to this embodiment. FIG. 3 is a cross-sectional view of lighting apparatus 10 according to this embodiment taken along line III-III in FIG. 2.

Figure 2:
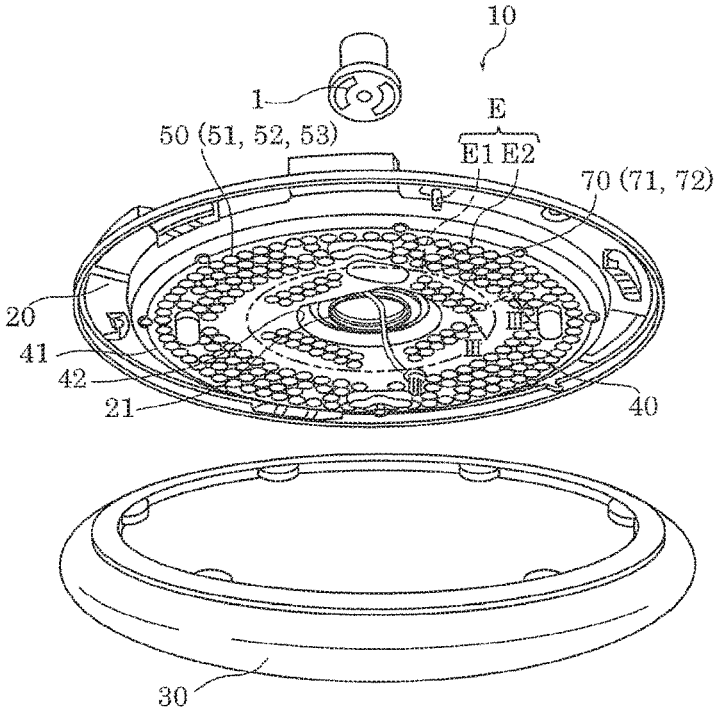
FIG. 2 is an exploded perspective view of the lighting apparatus according to the embodiment.

As illustrated in FIG. 1 and FIG. 2, lighting apparatus 10 includes device body 20, cover 30, and light emitter 40. Lighting apparatus 10 is detachably attached to, for example, hook ceiling body 1 provided in the ceiling of a building such as a house, for example.

Device body 20 is a casing for supporting cover 30 and light emitter 40. Device body 20 is formed in a ring shape having circular opening 21 in the center portion. Hook ceiling body 1 is connected to light emitter 40 via opening 21.

It should be noted that device body 20 is formed in the stated shape by performing press working on sheet metal such as an aluminum plate or a steel plate, for example. In order to increase reflectivity to improve light extraction efficiency, white coating is applied onto or a reflective metal material is vapor-deposited onto an inner surface (floor-side surface) of device body 20.

Cover 30 is an external cover for covering the entire inner surface of device body 20, and is detachably attached to device body 20. Accordingly, light emitter 40 is disposed inside cover 30. Cover 30 is formed in a circular dome shape. Cover 30 is formed of a light-transmissive resin material such as, for example, acrylics (PMMA), polycarbonate (PC), polyethylene terephthalate (PET), or polyvinyl chloride (PVC). Accordingly, light emitted by light emitter 40 toward the inner surface of cover 30 passes and exits through cover 30. It should be noted that cover 30 may be provided with a light-diffusing property by forming cover 30 using a milk-white resin material.

Light emitter 40 is a light source for emitting white light, for example. Specifically, light emitter 40 includes substrate 41, light emitting elements 50 and light emitting elements 70 which are mounted on a mounting surface (floor-side surface) of substrate 41.

Substrate 41 is a printed-circuit board for mounting light emitting elements 50, and is formed in a ring shape having circular opening 42 in the center portion. A wiring pattern (not illustrated) for mounting light emitting elements 50 is formed on substrate 41. Light emitting elements 50 are disposed (mounted) in periphery portion E2 inside predetermined region E in substrate 41. The wiring pattern is for supplying direct current from a circuit portion (including constant-power output circuit 11 and control circuit 12: see FIG. 6) to light emitting elements 50, by electrically connecting light emitting elements 50 to the circuit portion. Light emitting elements 50 are disposed on substrate 41 in multiple rings.

Furthermore, light emitter 40 includes light emitting elements 70 mounted on the opening 42-side of substrate 41. Light emitting elements 70 are disposed (mounted) in center portion E1 inside predetermined region E in substrate 41. Center portion E1 is different from periphery portion E2 and is a portion in the inner circumference side of periphery portion E2. In this embodiment, light emitter 40 is disposed to surround the perimeter of opening 21 of device body 20. It should be noted that there is no particular limitation as to the number of light emitters 40.

Light emitting elements 50 and 70 are, for example, packaged surface-mount device (SMD)-type white LED elements. It should be noted that a chip on board (COB)-type module in which an LED chip is mounted directly on substrate 41 may be used.

Figure 3:
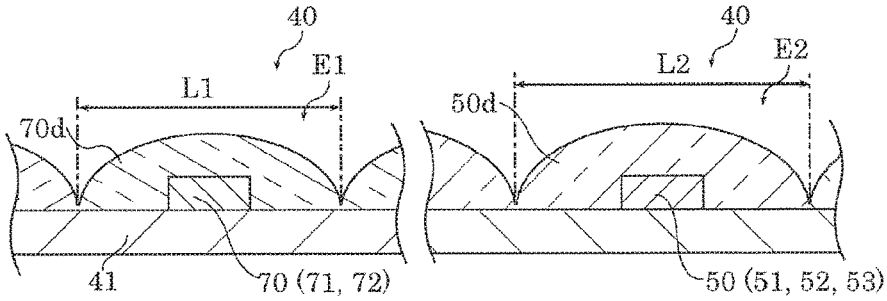
FIG. 3 is a cross-sectional view of the lighting apparatus according to the embodiment taken along line III-III in FIG. 2.

As illustrated in FIG. 3, the portion of light emitter 40 located in periphery portion E2 includes, aside from light emitting elements 50 and substrate 41, lenses 50*d*. Lenses 50*d* are stacked on light emitting elements 50 so that the optical axis of each of light emitting elements 50 approximately coincides with the axis of the corresponding one of lenses 50*d*. The outer diameter of lenses 50*d* is represented as L2.

Furthermore, the portion of light emitter 40 located in center portion E1 includes, aside from light emitting elements 70 and substrate 41, lenses 70*d*. The outer diameter of lenses 70*d* is represented as L1, and is smaller than outer diameter L2 of lenses 50*d*. Each of lenses 50*d* and each of lenses 70*d* is connected to another adjacent lens 50*d* and 70*d*, respectively, and the entirety make up a single lens body. The lens body covers light emitting elements 50 and 70. With regard to other features, light emitting elements 50 has the same features as light emitting elements 70, and thus description thereof is omitted. This also holds true for lenses 50*d* and 70*d*, and thus description thereof is also omitted.

Lenses 70*d* of first light emitting elements 71 and second light emitting elements 72 (described later) have a smaller outer diameter than lenses 50*d* of first light emitting elements 51 and second light emitting elements 52 (described later). Accordingly, first light emitting elements 71 and second light emitting elements 72 in center portion E1 are more densely disposed than first light emitting elements 51 and second light emitting elements 52 in periphery portion E2.

The diffusivity of lenses 70*d* disposed in center portion E1 in predetermined region E is smaller than the diffusivity of lenses 50*d* disposed in periphery portion E2 in predetermined region E. Accordingly, since light having a stronger intensity is emitted from center portion E1 than from periphery portion E2, light having strong intensity is emitted to the area directly below lighting apparatus 10 and the vicinity of the area.

Lenses 50*d* and 70*d* use a resin material such as acrylics or polyethylene terephthalate (PET), or glass as a base material. Lenses 50*d* and 70*d* may be milk-white lenses inside which a light-diffusing material has been dispersed. Such lenses 50*d* and 70*d* may be fabricated by way of a light-transmissive resin material into which a light-diffusing material has been mixed being resin molded into a predetermined shape. Light-reflecting particles, such as silica particles, can be used for the light-diffusing material.

Furthermore, instead of dispersing a light-diffusing material inside lenses 50*d* and 70*d*, lenses 50*d* and 70*d* may be configured by forming a milk-white light-diffusing film including a light-diffusing material, etc. on a surface (inner surface or outer surface) of lenses 50*d* and 70*d*. It should be noted that dispersion, etc. of such a light-diffusing material need not be performed for lenses 70*d*.

Light emitting elements 50 include first light emitting elements 51, second light emitting elements 52, and third light emitting elements 53. Furthermore, light emitting elements 70 include first light emitting elements 71 and second light emitting elements 72. Lenses 50*d* and 70*d* are disposed at positions opposite first light emitting elements 51 and 71 and second lighting elements 52 and 72. Furthermore, lenses 50*d* are disposed at positions opposite third light emitting elements 53. It should be noted that first light emitting elements 51 and first light emitting elements 71 are substantially identical light emitting elements, and second light emitting elements 52 and second light emitting elements 72 are substantially identical light emitting elements.

Light emitting elements 50 and light emitting elements 70 are dispersedly disposed in predetermined region E. In other words, first light emitting elements 51 and 71, second light emitting elements 52 and 72, and third light emitting elements 53 are dispersedly disposed in predetermined region E. Specifically, first light emitting elements 51, second light emitting elements 52, and third light emitting elements 53 are disposed in periphery portion E2 inside predetermined region E, and first light emitting elements 71 and second light emitting elements 72 are disposed in center portion E1 inside predetermined portion E.

First light emitting elements 51 and 71 are more densely disposed in periphery portion E2 than in center portion E1 in predetermined region E. Furthermore, second light emitting elements 52 and 72 are more densely disposed in center portion E1 than in periphery portion E2 in predetermined region E. In addition, third light emitting elements 53 are more densely disposed in periphery portion E2 than in center portion E1 in predetermined region E.

In this embodiment, center portion E1 inside predetermined region E is a region on opening 42 side of substrate 41, and periphery portion E2 inside predetermined region E is a region on the peripheral side of substrate 41 and is a region on the outer circumference side of center portion E1. It should be noted that the substrate of center portion E1 and the substrate of periphery portion E2 may be separated in to different substrates.

First light emitting elements 51 and 71 and second light emitting elements 52 and 72 have chromaticity values in the same chromaticity range. Here, the "same chromaticity range" is a range for one of light source colors (daylight color, day white color, white color, warm white color, and electric lamp color) standardized in JIS Z9112-2012 "Classification of fluorescent lamps and light emitting diodes by chromaticity and colour rendering property". For example, if first light emitting elements 51 and 71 have chromaticity values that fall within the chromaticity range for daylight color, second light emitting elements 52 and 72 also have chromaticity values that fall within the chromaticity range for daylight color.

The correlated color temperature of the combined light of first light emitting elements 51 and 71 and second light emitting elements 52 and 72 is at least 5500 K and at most 7100 K. In particular, the correlated color temperature of the combined light of first light emitting elements 51 and 71 and second light emitting elements 52 and 72 is preferably at least 5800 K.

The correlated color temperature of third light emitting elements 53 is at least 2600 K and at most 5500 K. Third light emitting elements 53 have a color temperature lower than the respective color temperatures of first light emitting elements 51 and 71 and second light emitting elements 52 and 72.

Next, the spectral distributions of first light emitting elements 51 and 71 and second light emitting elements 52 and 72 will be described using FIG. 4.

Figure 4:
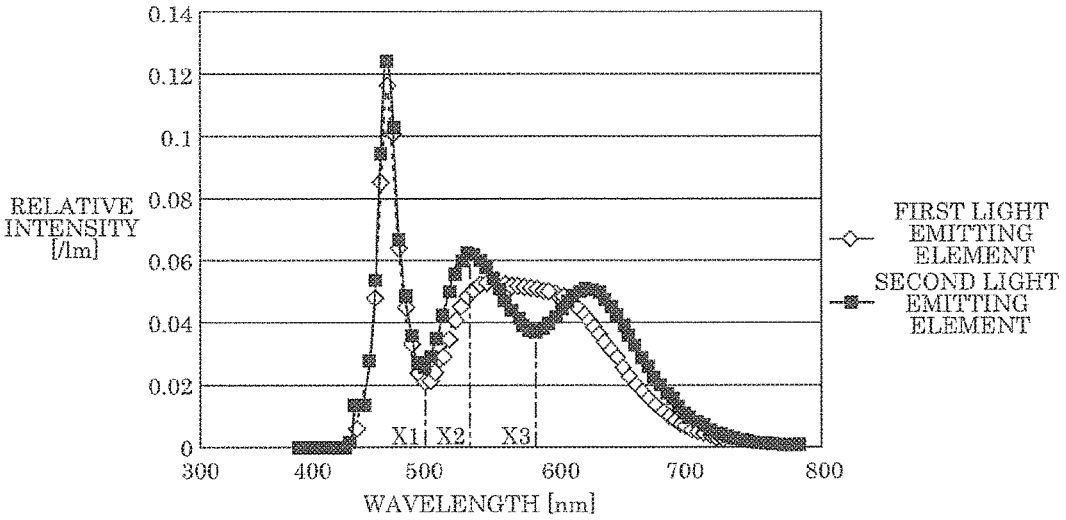
FIG. 4 is a graph illustrating examples of spectral distributions of first light emitting elements and second light emitting elements according to the embodiment.

FIG. 4 is a graph illustrating examples of spectral distributions of first light emitting elements 51 and 71 and second light emitting elements 52 and 72 according to this embodiment.

As illustrated in FIG. 4, first light emitting elements 51 and 71 have a spectral distribution with a first peak wavelength in a range of 425 nm to 480 nm inclusive, and a second peak wavelength in a range of 500 nm to 560 nm inclusive. Second light emitting elements 52 and 72 have a spectral distribution with a first peak wavelength in a range of 425 nm to 480 nm inclusive, a second peak wavelength in a range of 500 nm to 560 nm inclusive, and a third peak wavelength in a range of 580 nm to 650 nm inclusive.

Comparison between first light emitting elements 51 and 71 and second light emitting element 52 and 72 shows that the spectral distribution of first light emitting elements 51 and 71 has a higher priority to light emission efficiency than that of second light emitting elements 52 and 72. In contrast, the spectral distribution of second light emitting elements 52 and 72 has a higher priority to a color rendering property than that of first light emitting elements 51 and 71.

Here, in FIG. 4, a local maximum at the second peak wavelength of the spectral distribution of second light emitting elements 52 and 72 is second value X2, a local minimum on the negative side relative to second value X2 is first value X1, and a local minimum on the positive side relative to second value X2 is third value X3. In the example in FIG. 4, first value X1 is 480 nm, second value X2 is 520 nm, and third value X3 is 570 nm.

Next, the arrangement of first light emitting elements 51 and 71, second light emitting elements 52 and 72, and third light emitting elements 53 will be described using FIG. 5.

Figure 5:
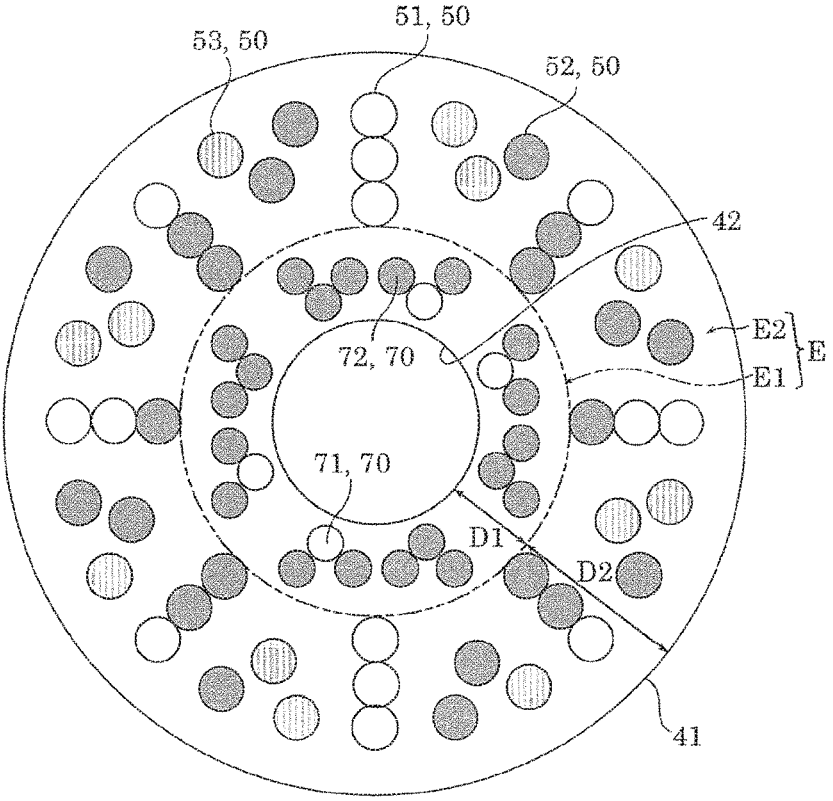
FIG. 5 is a schematic diagram illustrating an example of arrangement of the first light emitting elements, the second light emitting elements, and third light emitting elements according to the embodiment.

FIG. 5 is a schematic diagram illustrating an example of the arrangement of first light emitting elements 51 and 71, second light emitting elements 52 and 72, and third light emitting elements 53 according to this embodiment. Accordingly, since FIG. 5 is a schematic diagram, it does not necessarily conform to FIG. 2. It should be noted that the layout of first light emitting elements 51 and 71, second light emitting elements 52 and 72, and third light emitting elements 53 may be arbitrarily changed, and is not limited to the layout in FIG. 5.

As illustrated in FIG. 5, 14 first light emitting elements 51, 22 second light emitting elements 52, and 12 third light emitting elements 53 are mounted on periphery portion E2 of substrate 41. First light emitting elements 51, second light emitting elements 52, and third light emitting elements 53 are disposed in substrate 41 according to a predetermined rule. Furthermore, 4 first light emitting elements 71 and 20 second light emitting elements 72 are mounted on center portion E1 of substrate 41.

Specifically, first light emitting elements 51 and 71, second light emitting elements 52 and 72, and third light emitting elements 53 are disposed not by being packed in a single place inside light emitter 40 but are dispersedly disposed.

Furthermore, although both center portion E1 and periphery portion E2 are in a ring shape, center portion E1 and periphery portion E2 may be defined as indicated below. Specifically, the ratio of width D1, from the inner diameter to the outer diameter of center portion E1, to width D2, from the inner diameter to the outer diameter of periphery portion E2, is from 1:1 to 1:2. In this embodiment, D1:D2 is set to 1:2 as illustrated in FIG. 5.

Next, the configuration of lighting apparatus 10 will be described using FIG. 6.

Figure 6:
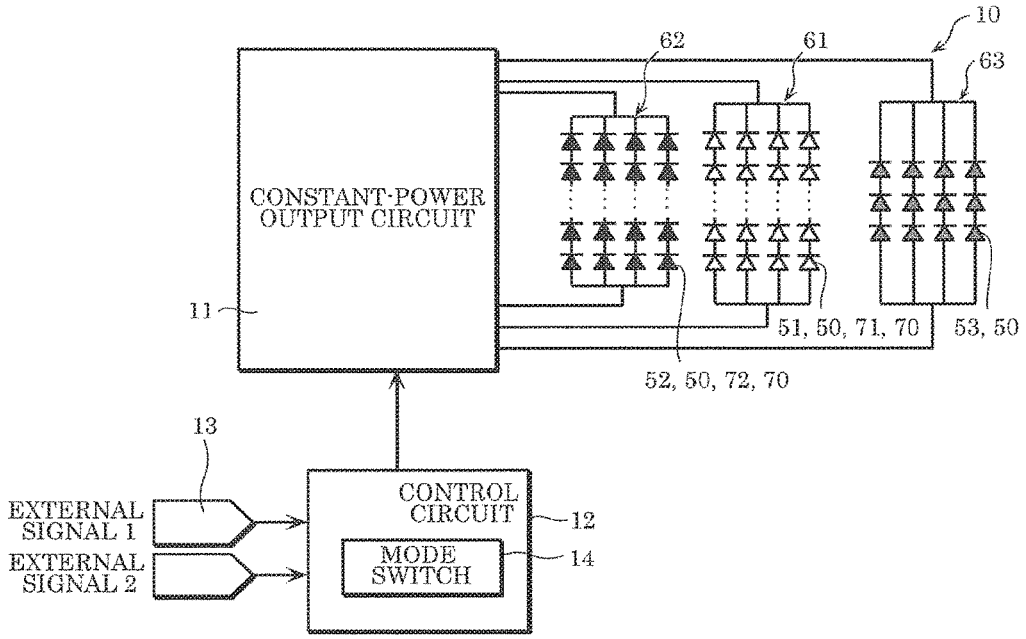
FIG. 6 is a block diagram illustrating the lighting apparatus according to the embodiment.

FIG. 6 is a block diagram illustrating lighting apparatus 10 according to this embodiment.

As illustrated in FIG. 6, first light emitting module 61 includes first light emitting elements 51 and 71, second light emitting module 62 includes second light emitting elements 52 and 72, and third light emitting module 63 includes third light emitting elements 53. In addition, first light emitting module 61, second light emitting module 62, and third light emitting module 63 are electrically connected to constant-power output circuit 11 using mutually different routes. As such, first light emitting module 61, second light emitting module 62, and third light emitting module 63 can be controlled using mutually different current values. Accordingly, the ratio of light emitted by first light emitting elements 51 and 71, second light emitting elements 52 and 72, and third light emitting elements 53 can be adjusted.

Lighting apparatus 10 includes constant-power output circuit 11 and control circuit 12.

Constant-power output circuit 11 is a circuit for supplying constant power to light emitting elements 50.

Control circuit 12 controls constant-power output circuit 11 when an external signal (external signal 1 described later) for lighting is input by, for example, a light-on switch which is not illustrated being turned on, and causes light emitting elements 50 to emit light.

Two external signals are input to control circuit 12. One of the external signals (external signal 1) is a signal for lighting and the other external signal (external signal 2) is a signal including information indicating the age or generation of viewers. When an input of an age or generation is input from a user to setter 13 which inputs (sets) the other external signal to control circuit 12, setter 13 generates an external signal including information indicating the age or generation and inputs this external signal to control circuit 12. It should be noted that, instead of the user directly inputting his/her age, age may be input by a camera sensor sensing the user's age.

Control circuit 12 includes mode switch 14 capable of controlling first light emitting elements 51 and 71 and second light emitting elements 52 and 72 separately. It should be noted that although mode switch 14 is provided inside control circuit 12 in this embodiment, mode switch 14 may be a separate body from control circuit 12.

When mode switch 14 receives, for example, a signal including information indicating the age or generation of a user from setter 13, mode switch 14 switches between the first mode and the second mode to be described later, according to the age or generation of the user. Control circuit 12 selectively executes the first mode which causes first light emitting elements 51 and 71 to emit light and the second mode which causes first light emitting elements 61 and 71 and second light emitting elements 52 and 72 to emit light. The first mode and the second mode are generically referred to as modes.

The first mode is a mode for executing normal lighting performed by typical illumination. The second mode is a mode that executes lighting capable of increasing the color perception percentage for old aged people, and faithfully reproduces a color while improving readability of letters compared to the first mode. Control circuit 12 causes brighter light emission when causing light emission in the second mode than when causing light emission in the first mode. Here, brightness is not limited to illuminance, and also means luminous flux.

In the second mode, control circuit 12 causes the output of first light emitting elements 51 disposed in periphery portion E2 of predetermined region E to be lower than in the first mode, and causes the output of second light emitting elements 72 disposed in center portion E1 of predetermined region E to be higher than in the first mode.

When mode switch 14 switches to the first mode, control circuit 12 causes mainly first light emitting elements 51 and 71 to emit light. Furthermore, when mode switch 14 switches to the second mode, control circuit 12 causes at least first light emitting elements 51 and 71 and second light emitting elements 52 and 72 to emit light. It should be noted that, in the first mode, aside from first light emitting elements 51 and 71, second light emitting elements 52 and 72 and third light emitting elements 53 may also emit light. However, control circuit 12 performs control to cause brighter light emission when causing second light emitting elements 52 and 72 and third light emitting elements 53 to emit light in the second mode than when causing second light emitting elements 52 and 72 and third light emitting elements 53 to emit light in the first mode. It should be noted that, in the first mode, it is sufficient that either only first light emitting elements 51 and 71 or only third light emitting elements 53 emit light.

Light emitting elements 50 are divided into a plurality of groups, and the groups of light emitting elements 50 are electrically connected to constant-power output circuit 11 using mutually different routes. Four groups each including first light emitting elements 51 and 71 are provided, four groups each including second light emitting elements 52 and 72 are provided, and four groups each including third light emitting elements 53 are provided. In addition, first light emitting elements 51 and 71, second light emitting elements 52 and 72, and third light emitting elements 53 in each group are electrically connected in series.

Accordingly, control circuit 12 controls first light emitting elements 51 and 71, second light emitting elements 52 and 72, and third light emitting elements 53 using current having different values, by controlling constant-power output circuit 11. Therefore, the light color of entire lighting apparatus 10 is adjusted.

It should be noted that when the light color of entire lighting apparatus 10 is not to be adjusted, first light emitting elements 51 and 71, second light emitting elements 52 and 72, and third light emitting elements 53 may be disposed in the same circuit and controlled using current having the same value.

[Combined Light]

The following describes combined light which is a combination of light emitted by first light emitting elements 51 and 71 and second light emitting elements 52 and 72.

Figure 7:
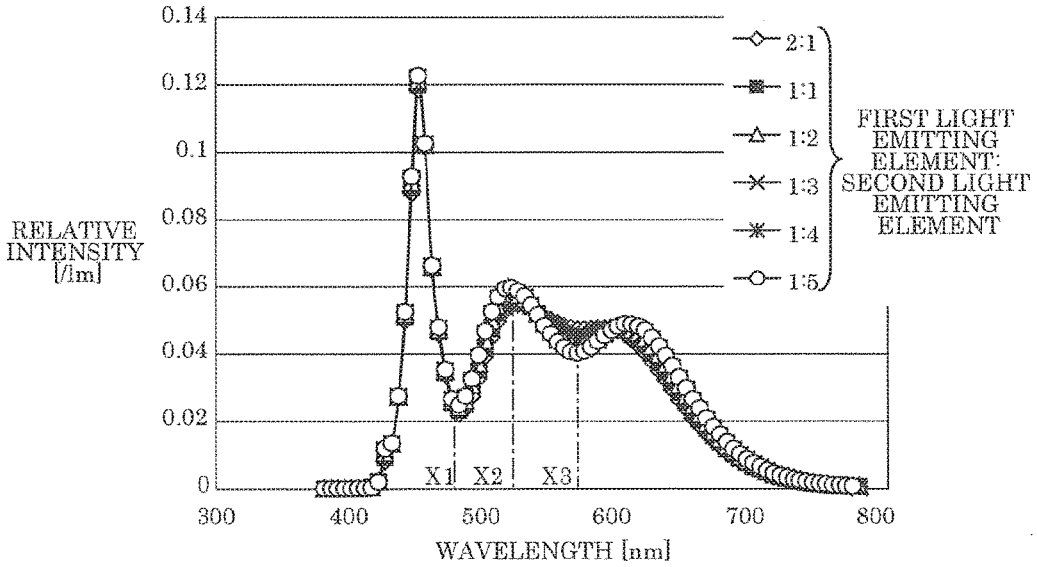
FIG. 7 is a graph illustrating, when the ratio in number of the first light emitting elements to the second light emitting elements according to the embodiment is changed, spectral distributions of combined light at the ratios in number.

FIG. 7 is a graph illustrating, when the ratio in number of first light emitting elements 51 and 71 to second light emitting elements 52 and 72 according to this embodiment is changed, spectral distributions of combined light at the ratios in number. FIG. 7 illustrates the spectral distributions (relations between wavelength and relative intensity) of combined light at the ratios in number, in the second mode.

FIG. 7 illustrates spectral distributions of combined light when the ratio in number of first light emitting elements 51 and 71 to second light emitting elements 52 and 72 is 2:1, 1:1, 1:2, 1:3, 1:4, and 1:5.

Next, based on the results, proportions of relative intensities (relative intensity ratios) at first value X1 and third value X3 of spectral distributions of light emitted by the light emitting elements having the ratios in number were calculated, when the relative intensities at second value X2 were assumed to be 1.

FIG. 8 is a graph illustrating changes of relative intensity ratios at first value X1 and third value X3 of spectral distributions of light emitted by the light emitting elements having the ratios in number according to this embodiment, when the relative intensities at second value X2 are 1.

As illustrated in FIG. 8, the relative intensity ratios at first value X1 do not show significant changes at any spectral distributions, yet the relative intensity ratios at third value X3 decrease with an increase in the proportion of second light emitting elements 52 and 72.

Furthermore, it can be seen that if the percentage of second light emitting elements 52 and 72 among first light emitting elements 51 and 71 and second light emitting elements 52 and 72 satisfies at least a 2:1 ratio in number of first light emitting elements 51 and 71 to second light emitting elements 52 and 72, the relative intensity ratios of light having third value X3 when the relative intensity at second value X2 is 1 is 0.85 or lower in either case. Specifically, regarding a spectral distribution of combined light which is a combination of the light emitted by first light emitting elements 51 and 71 and the light emitted by second light emitting elements 52 and 72, if a ratio of the greatest value (relative intensity at second value X2) in a range of 500 nm to 560 nm inclusive to the smallest value (relative intensity at third value X3) in a range of 500 nm to 650 nm inclusive is 0.85 or lower, color perception percentage for old aged people can be secured to a certain degree.

FIG. 9 is a table illustrating optical characteristics of entire lighting apparatus 10 at the ratios in number of first light emitting elements 51 and 71 to second light emitting elements 52 and 72 to third light emitting elements 53 according to this embodiment.

As illustrated in FIG. 9, the optical characteristics of entire lighting apparatus 10 are optical characteristics of combined light which is a combination of light emitted by first light emitting elements 51 and 71, light emitted by second light emitting elements 52 and 72, and light emitted by third light emitting elements 53. As is clear from FIG. 9, excluding third light emitting elements 53, at all the ratios in number, the correlated color temperatures of the combined light of first light emitting elements 51 and 71 and second light emitting elements 52 and 72 are at least 5500 K and at most 7100 K. Furthermore, the correlated color temperature of third light emitting elements 53 is at least 2600 K and at most 5500 K.

Here, a feeling of contrast index (FCI) is a so called index for distinctness and is proposed in, for example, Japanese Unexamined Patent Application Publication No. H09-120797. Specifically, FCI is a percentage of brightness perceived under standard light D65, based on color appearance. As is clear from FIG. 9, at all the ratios in number, the index for distinctness FCI of light emitted by lighting apparatus 10 in the second mode is at least 93 and at most 120. Since there is a report that discomfort is imparted when FCI exceeds 120, an upper limit is provided for the FCI.

The general color rendering index Ra of light emitted by lighting apparatus 10 in the second mode is at least 86 and at most 100. The general color rendering index Ra is an index for evaluating faithful reproduction of color, and a guide for the indexes is indicated in JIS Z9112 "Classification of fluorescent lamps by chromaticity and colour rendering property". More specifically, in the second mode, the general color rendering index Ra is preferably 90 or more. As is clear from FIG. 9, in the second mode, at all the ratios in number, the general color rendering index Ra is at least 86 and at most 100.

For the light emitted by lighting apparatus 10 in the second mode, a chroma value calculated using the CIE 1997 Interim Color Appearance Model (Simple Version) being 2.0 or less. The chroma value is an index for quantitatively evaluating whitishness of an object to be viewed. Chromaticness is high when the chroma value is large, whereas chromaticness is low when the chroma value is small. Chroma value is an index disclosed in, for example, Japanese Unexamined Patent Application Publication No. 2014-75186. Accordingly, when the chroma value is small, whitishness is high. As is clear from FIG. 9, in the second mode, the percentage of second light emitting elements 52 and 72 among first light emitting elements 51 and 71 and second light emitting elements 52 and 72 satisfies at least a 1:2 ratio in number of first light emitting elements 51 and 71 to second light emitting elements 52 and 72, the chroma value is 2.0 or less.

Figure 10:
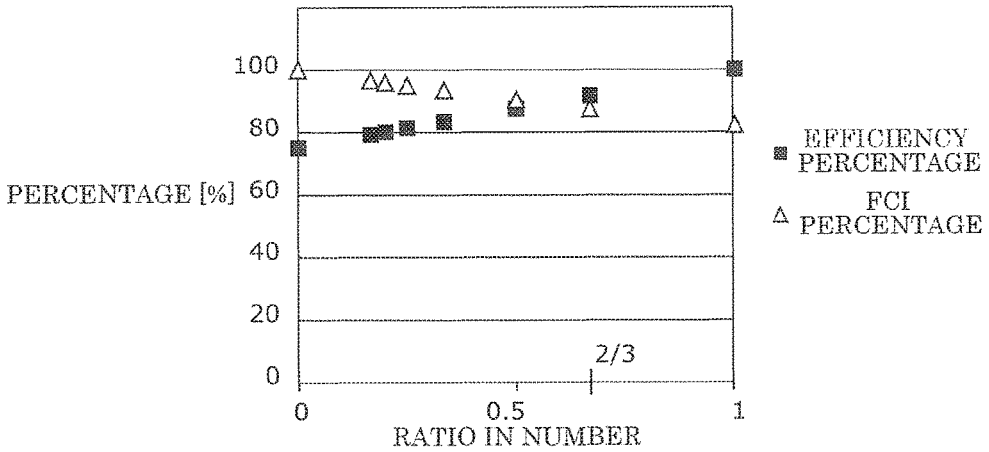
FIG. 10 is a graph illustrating a relation between ratio in number of the first light emitting elements to the second light emitting elements and an efficiency percentage and a FCI percentage in FIG. 9.

FIG. 10 is a graph illustrating a relation between ratio in number of first light emitting elements 51 and 71 to second light emitting elements 52 and 72 and an efficiency percentage and a FCI percentage in FIG. 9.

Here, when light emission efficiency achieved when only first light emitting elements 51 and 71 are used is 100%, the efficiency percentages are relatively calculated from light emission efficiency in other cases. When FCI achieved when only second light emitting elements 52 and 72 are used is 100%, the FCI percentages are relatively calculated from FCIs in other cases.

Here, the proportion in number is the proportion of the number of first light emitting elements 51 and 71 disposed to the number of all light emitting elements 50 disposed. In FIG. 10, for example, looking in order from when the proportion in number is "0", a proportion in number of "0" is the case where only second light emitting elements 52 and 72 are included, efficiency percentage is 75% and FCI percentage is 100%. Next, when the ratio in number is 1:5, the proportion in number is "0.17", efficiency percentage is 79%, and FCI percentage is 97%. Next, when the ratio in number is 1:4, the proportion in number is "0.20", efficiency percentage is 80%, and FCI percentage is 96%. Next, when the ratio in number is 1:3, the proportion in number is "0.25", efficiency percentage is 81%, and FCI percentage is 95%. Next, when the ratio in number is 1:2, the proportion in number is "0.33", efficiency percentage is 83%, and FCI percentage is 93%. Next, when the ratio in number is 1:1, the proportion in number is "0.5", efficiency percentage is 88%, and FCI percentage is 90%. Next, when the ratio in number is 2:1, the proportion in number is "0.67", efficiency percentage is 92%, and FCI percentage is 90%. A proportion in number of "1" is the case where only first light emitting elements 51 and 71 are included, efficiency percentage is 100% and FCI percentage is 82%.

Figure 11:
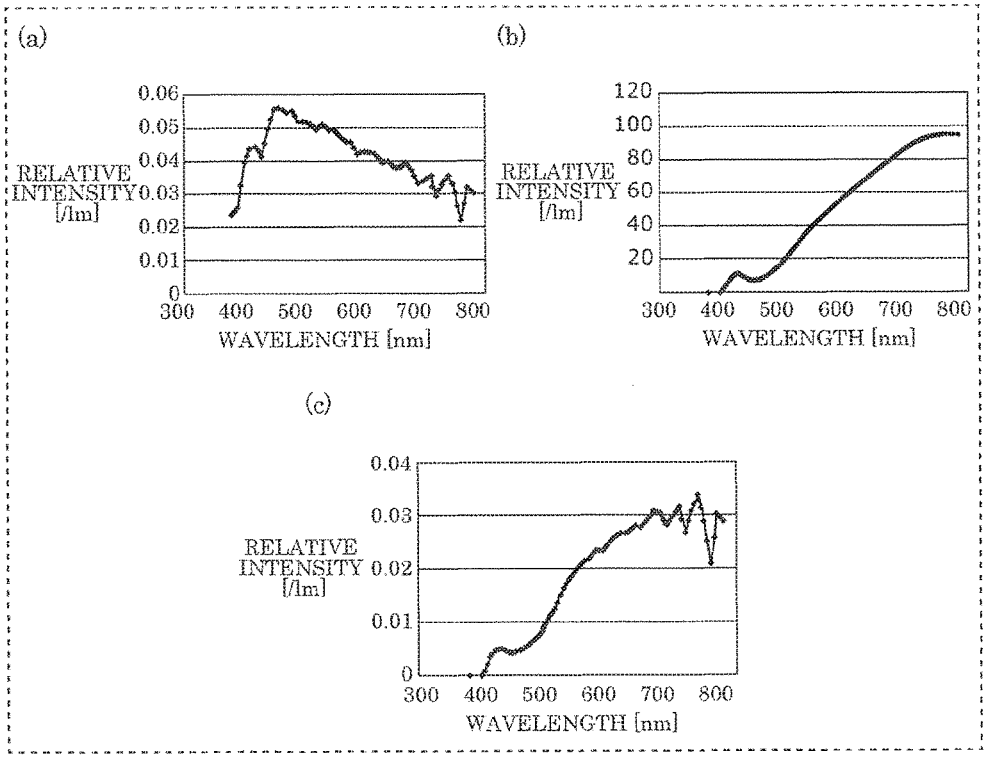
FIG. 11 is an explanatory diagram illustrating a spectral distribution of light from a standard light source when tint is evaluated, a filter for old aged people, and a spectral distribution obtained by applying the filter for old aged people to the spectral distribution of light from the standard light source.

Part (a) in FIG. 11 is a graph illustrating a spectral distribution of light from a D65 light source used as a standard light source when tint is evaluated. Part (b) in FIG. 11 is a graph illustrating a filter for old aged people based on a difference obtained by subtracting spectral transmittance of old aged viewers from spectral transmittance of viewers in maturing age. Part (c) in FIG. 11 is a graph illustrating a spectral distribution obtained by applying the filter for old aged people in (b) in FIG. 11 to the spectral distribution in (a) in FIG. 11. Based on the spectral distribution in (c) of FIG. 11, how much the light color perceived by old aged people varies relative to the light color perceived by the viewers in maturing age is estimated.

Figures 12, 13:
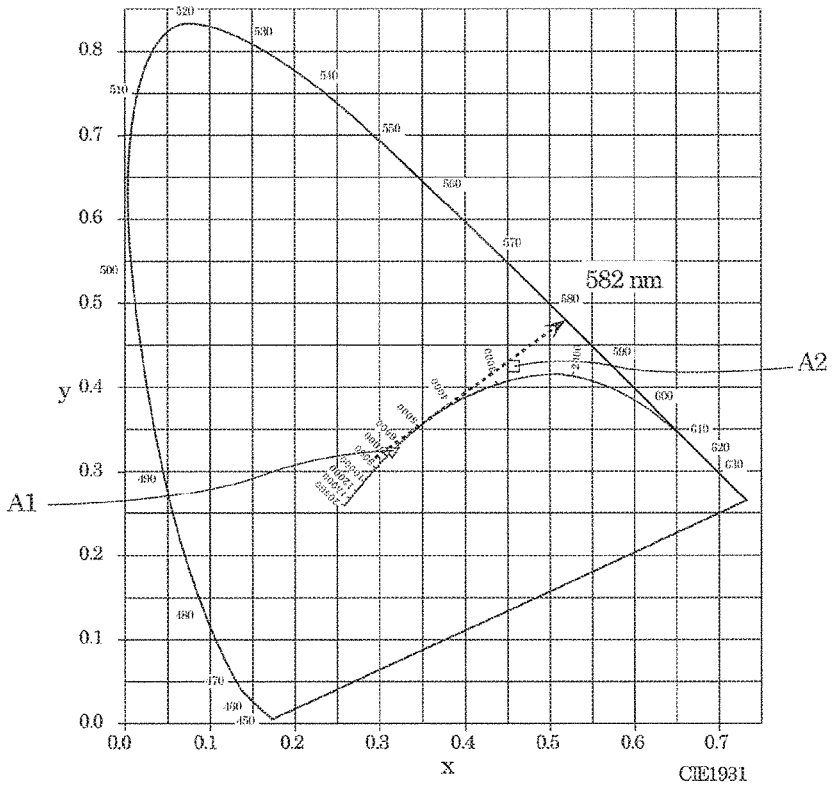
FIG. 12 is a chromaticity coordinate graph showing outputs of chromaticity coordinates of a D65 light source in FIG. 11 and chromaticity coordinates of the D65 light source when the filter for old aged people is applied.
FIG. 13 is a table illustrating optical characteristics of light emitted by third light emitting elements and test 1 light to test 3 light used for color mixture in a verification experiment.

FIG. 12 is a chromaticity coordinate graph showing outputs of chromaticity coordinates A1 of the D65 light source in FIG. 11 and chromaticity coordinates A2 of the D65 light source when the filter for old aged people is applied. As illustrated in FIG. 11, by applying the filter for old aged people, the chromaticity coordinates indicating a color perceived by the viewer changes from chromaticity coordinates A1 to chromaticity coordinates A2. Extending a straight line that connects chromaticity coordinates A1 and A2 shows that the chromaticity in a wavelength range near 582 nm is increasing for the old aged people. Accordingly, a relative intensity in a wavelength range which includes 582 nm of combined light which is a combination of light emitted by first light emitting elements 51 and light emitted by second light emitting elements 52 is decreased, and thus old aged people can perceive a color indicated by similar chromaticity to that of the viewers in maturing age. Here, the wavelength range which includes 582 nm includes a wavelength whose relative intensity is the lowest in a range of 500 nm to 650 nm inclusive in a spectral distribution, and specifically is a wavelength range which includes third value X3.

[Verification Experiment]

The inventors examined, by the experiment, how FCI percentages influenced how colors appear to viewers.

The summary of the experiment is as follows.

The color of reference light (correlated color temperature: 6200 K) was adjusted by mixing light emitted by highly efficient first light emitting elements 51 and 71 having a high color temperature (correlated color temperature: 6300 K) and light emitted by highly efficient light emitting elements (third light emitting elements) having a low color temperature (correlated color temperature: 2400 K). Three types of test light, tests 1 to 3, were adjusted to have 6200 K by changing the ratio of first light emitting elements 51 and 71 to high color rendering second light emitting elements 52 and 72 having a high color temperature (correlated color temperature: 6500 K) and further adding third light emitting elements 53. Specifically, test 1 light was adjusted to have approximately 6200 K by adding third light emitting elements 53 to a group of only first light emitting elements 51 and 71. Test 2 light was adjusted to have approximately 6200 K by adding third light emitting elements 53 to a group of first light emitting elements 51 and 71 and second light emitting elements 52 and 72 whose ratio in number is 1 to 3. Test 3 light was adjusted to have approximately 6200 K by adding third light emitting elements 53 to a group of only second light emitting elements 52 and 72.

FIG. 13 is a table illustrating optical characteristics of light emitted by third light emitting elements 53 and test 1 light to test 3 light used for color mixture in the verification experiment.

Here, the eyes of accommodative power have a peak at the age of 10 and gradually decreases, and when the person is over 45, he/she starts perceiving a subjective symptom such as "unclear appearance of small letters" and "blurred vision." This is the beginning of "presbyopia." Viewers for this experiment were 15 people including 9 people in middle age, that is, aged 46 to 62, who already have a sign of presbyopia and 6 people in maturing age, that is, aged 27 to 37, who have not had a sign of presbyopia.

A ¥120 downlight which emits the reference light and ø120 downlights which emit test 1 light, test 2 light, and test 3 light were disposed in evaluation boxes (size: W300×D300×H500 [mm]/interior color: N7 for walls and N5 for bottom).

Objects to be viewed were Munsell color paper (hue, value/chroma: 5R4/14, 5R4/13, 5R4/12, 5R4/11, 5R4/10, 5R4/9; 5Y8/14, 5Y8/13, 5Y8/12, 5Y8/11, 5Y8/110, 5Y8/9; 5G4/10, 5G4/9, 5G4/8, 5G4/7, 5G4/6, 5G4/5; 10B4/10, 10B4/9, 10B4/8, 10B4/7, 10B4/6, 10B4/5) made by General Incorporated Foundation, Japan Color Research Institute.

In this experiment, in order to take into consideration the influence from whether the right or left eye is the dominant eye, one piece of color paper of each hue having second highest chroma (5R4/13, 5Y8/13, 504/9, or 10B4/9 paper) is placed under reference light, and six pieces of color paper of each hue having six chroma levels were disposed under test 1 light to test 3 light.

The evaluation method was that how color paper appears to one of the eyes under the reference light was compared with how color paper appears to the other eye under test 1 light to test 3 light, and a viewer selected one of six pieces of color paper, which the subject thought to be as "vivid" as the color paper under the reference light by paired comparison. The subject was allowed to select a color between two pieces of color paper.

The procedure of the verification experiment is indicated below.

When the illuminance of the reference light was 500 1× and the illuminance of test 1 to test 3 light was 500 1×, a viewer took three minutes to adapt one of the eyes to N5 colored paper in the reference light evaluation box and the other eye to one of the test 1 to test 3 evaluation boxes. After that, a piece of red paper, 5R4/13, was placed in the reference light evaluation box, and pieces of red paper, 5R4/14, 5R4/13, 5R4/12, 5R4/11, 5R4/10, and 5R4/9, were placed in each of the test 1 to test 3 evaluation boxes. Then, the viewer selected one of the pieces of red paper that appears as "vivid" as the red paper under the reference light. Subsequently, the viewer made evaluation similarly in the hue order of yellow, green, and blue. After the evaluation box was changed to the test 1, test 2, or test 3 evaluation box, the subject took one minute to adapt to the test light, and repeatedly made evaluation.

The results of the experiment were as follows.

Differences between color paper of the hues (5R4/13, 5Y8/13, 5G4/9, 10B4/9) in the test 1 evaluation box that appeared as vivid as color paper in the reference light box and selected color paper in the test 2 and 3 evaluation boxes which appeared as "vivid" as color paper in the reference light box (chroma difference=chroma of selected color paper under test 1 light−chroma of selected color paper under test 2 or 3 light) were averaged for four hues.

Figure 14:
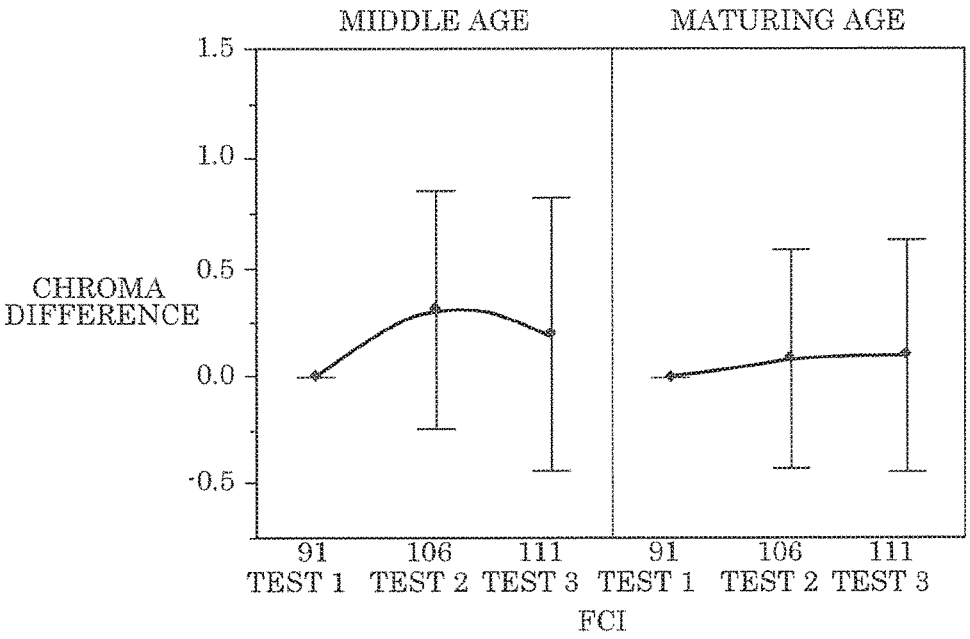
FIG. 14 is a graph illustrating relations between a chroma difference obtained by the verification experiment and test 1 light to test 3 light, separately for middle aged viewers and maturing aged viewers.
Figure 15:
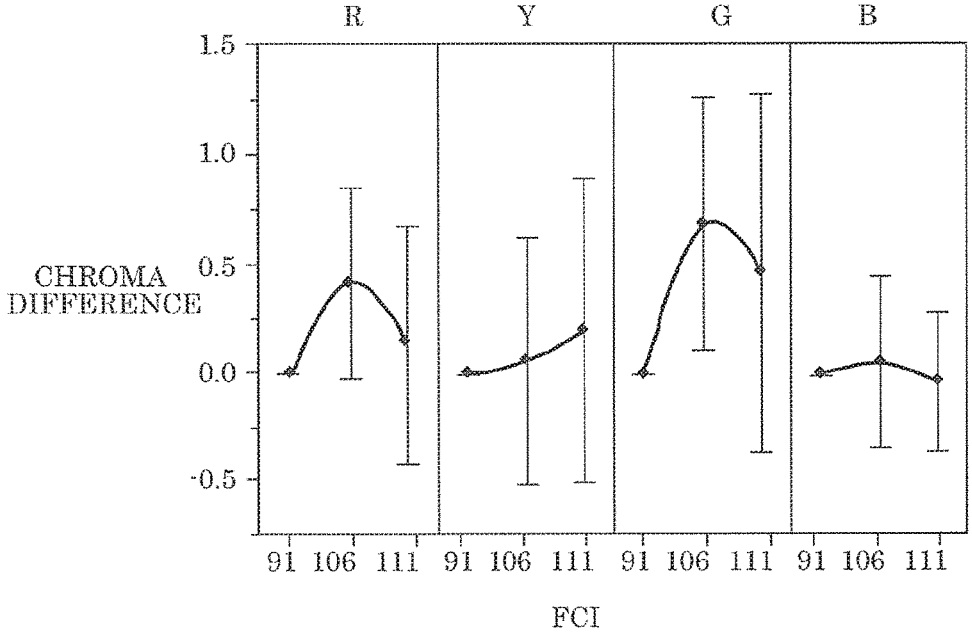
FIG. 15 is a graph illustrating relations between test 1 to test 3 light and chroma differences for the four hues for middle aged viewers obtained by the verification experiment.

FIG. 14 is a graph illustrating relations between a chroma difference obtained by the verification experiment and test 1 light to test 3 light, separately for middle aged viewers and maturing aged viewers. FIG. 15 is a graph illustrating relations between test 1 to test 3 light and chroma differences for the four hues for middle aged viewers obtained by the verification experiment.

As illustrated in FIG. 14, more noticeable increase in chroma depending on spectra is achieved for middle aged viewers than for maturing aged viewers, and test 2 light and test 3 light achieve substantially the same effects. Furthermore, as illustrated in FIG. 15, for middle aged viewers, test 2 illumination light yielded more noticeable increase in chroma of green (G) paper and red (R) paper, than test 1 illumination light. Although increase in chroma of yellow (Y) is not noticeable, an increase in FCI is slightly yielded for yellow (Y). In contrast, FCI is slightly decreased for blue (B).

The above results show that test 1 light and test 2 light improved appearance of red and green. At 6200 K, a difference in FCI between test 1 light and test 2 light is 15, and a difference in FCI between test 2 light and test 3 light is 5. If a difference between FCIs is 10 or more, it can be said that the difference improves appearance of red and green for middle aged viewers. According to the above condition, FCI of test 1 light higher than 91 by 10 or more is 101 or more. The correlated color temperatures of test 1 light to test 3 light are 6200 K, which is achieved by mixing light emitted by first light emitting elements 51 and 71, second light emitting elements 52 and 72, and third light emitting elements 53. In this manner, FCI is higher by about 3 than FCI of light which has a correlated color temperature of 6500 K and is a combination of light emitted by only first light emitting elements 51 and 71 and second light emitting elements 52 and 72. Accordingly, the table illustrated in FIG. 9 shows that it is sufficient that FCI has a numerical value of at least 98, and it is sufficient that the percentage of second light emitting elements 52 and 72 among first light emitting elements 51 and 71 and second light emitting elements 52 and 72 is higher than a 2:1 ratio in number of first light emitting elements 51 and 71 to second light emitting elements 52 and 72.

Figure 16:
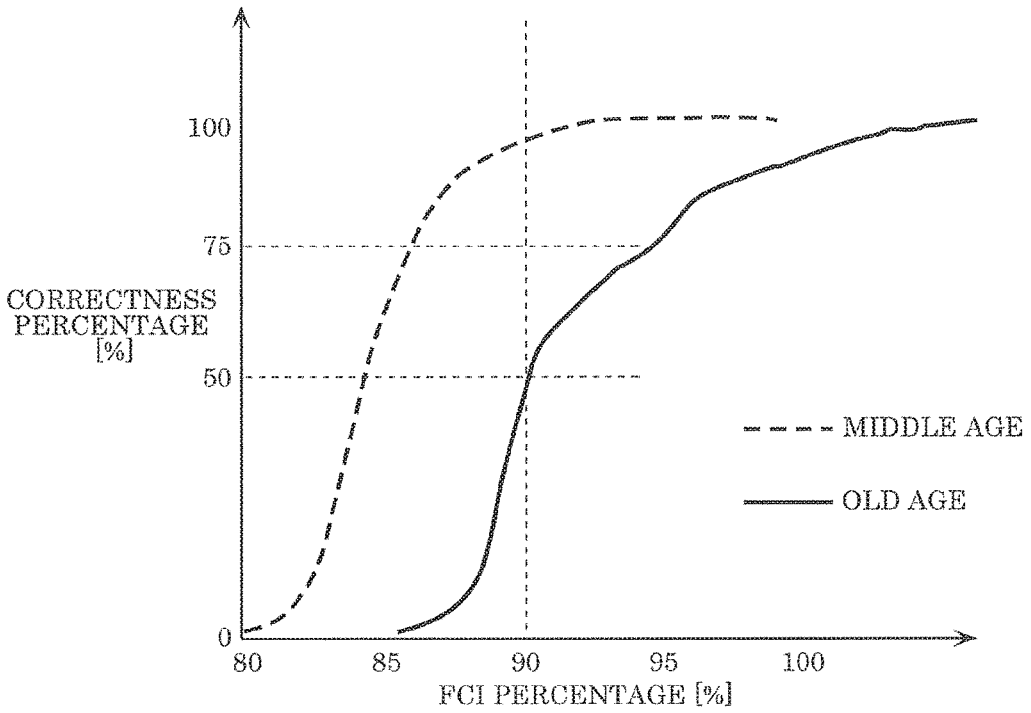
FIG. 16 is a graph illustrating the relation between generation and number of correct answers for contrast sensitivity obtained by an experiment.

FIG. 16 is a graph illustrating a relation between the FCI percentage of the illumination light and the correctness percentage of identifying the color of red paper, for middle aged viewers (45 to 64 years old) and old aged viewers (65 years old and above). In FIG. 16, middle aged viewers are indicated by a broken line and old aged viewers are indicated by a solid line.

Under light from one of light sources which emit light having different FCIs, three pieces of red paper arranged at constant intervals were presented to a viewer, and if the viewer thought that the three pieces of red paper included different red paper, the viewer answered the position of the different red paper. The correctness percentage indicates the percentage of viewers who correctly indicated the position. In the experiment, 5R4/11 was used as a reference color, and three pieces of the same color paper and three pieces of color paper that include one color paper having chroma indicated by 5R4/11.5, 5R4/12, 5R4/12.5, 5R4/13, 5R4/13.5, or 5R4/14 were presented. If the three pieces of color paper were the same, the subject answered "the same", and if the three pieces of color paper include different color paper, the subject answered the position "left, middle, or right". The graph in FIG. 16 indicates the correctness percentage when the three pieces of red paper include 5R4/11.5 color paper.

As is clear from FIG. 16, the correctness percentage is 50% or higher if the FCI percentage is greater than 90. In other words, based on the ratio in number of first light emitting elements 51 and 71 to second light emitting elements 52 and 72 which achieves the FCI percentage of 90 or higher, the numbers of first light emitting elements 51 and 71 and second light emitting elements 52 and 72 to be disposed may be determined. FIGS. 9 and 10 show that the ratio in number which achieves the FCI percentage of 90 or higher is 2:1. In other words, if the percentage of second light emitting elements 52 and 72 among first light emitting elements 51 and 71 and second light emitting elements 52 and 72 satisfies at least a 2:1 ratio in number of first light emitting elements 51 and 71 to second light emitting elements 52 and 72, the color perception percentage of viewers in the middle age and over can be secured to a certain degree. It should be noted that the color perception percentage is to be increased to 75% or higher, the ratio in number which achieves a FCI percentage of 93 or higher may be selected.

Furthermore, if the viewer's age is different, the relation between the FCI percentage and the correctness percentage is also different. For example, the FCI percentage at which the correctness percentage is 50% or higher is approximately 85% or higher for middle aged viewers, but is approximately 90% or higher for old aged people. Accordingly, even if the color perception percentage is to be maintained constant, the FCI percentage is different depending on age, and thus a desired color perception percentage can be secured for different ages by adjusting the ratio of light emitted by first light emitting elements 51 and 71 to light emitted by second light emitting elements 52 and 72.

In addition, as illustrated in FIG. 8, it can be seen that when the percentage of second light emitting elements 52 and 72 among first light emitting elements 51 and 71 and second light emitting elements 52 and 72 satisfies at least a 2:1 ratio in number of first light emitting elements 51 and 71 to second light emitting elements 52 and 72, the relative intensity ratios of light having third value X3 when the relative intensity at second value X2 is 1 is 0.85 or lower in either case. Specifically, regarding a spectral distribution of combined light which is a combination of the light emitted by first light emitting elements 51 and 71 and the light emitted by second light emitting elements 52 and 72, if a ratio of the greatest value (relative intensity at second value X2) in a range of 500 nm to 560 nm inclusive to the smallest value (relative intensity at third value X3) in the range of 500 nm to 650 nm inclusive is 0.85 or lower, color perception percentage for old aged people can be secured to a certain degree.

Figure 17:
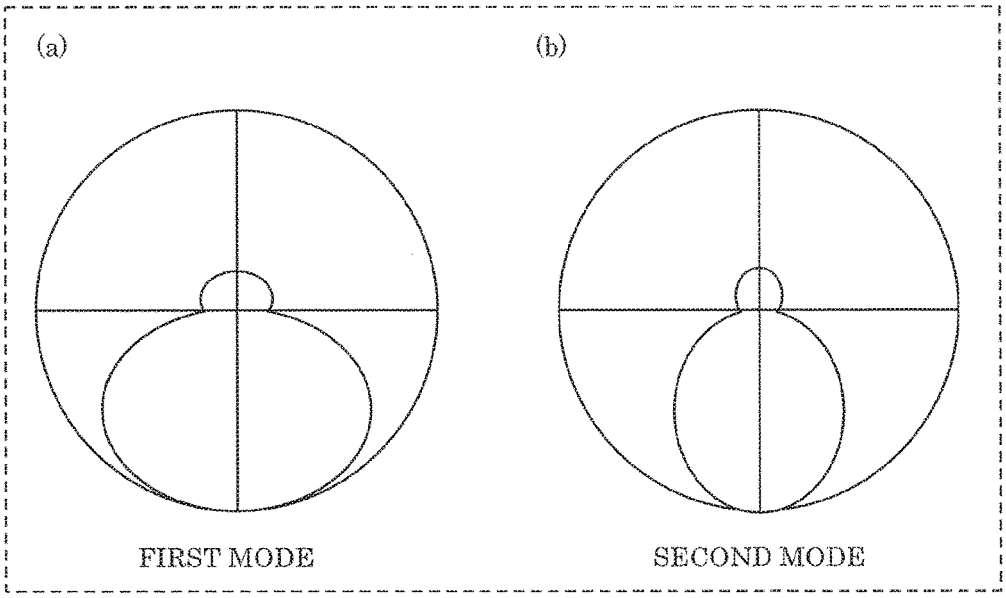
FIG. 17 is an explanatory diagram illustrating light distribution for the lighting apparatus in a first mode and light distribution for the lighting apparatus in a second mode.

Part (a) in FIG. 17 is a diagram illustrating light distribution for the lighting apparatus in a first mode. Part (b) in FIG. 17 is a diagram illustrating light distribution for the lighting apparatus in a second mode.

As illustrated in (a) and (b) in FIG. 17, comparing the second mode to the first mode, it can be seen that in the second mode, the width of the light distribution curve in the short axis direction is narrower than in the first mode. In other words, in the second mode, light of a high color temperature is emitted to the area directly under lighting apparatus 10 and the vicinity of the area more than in the first mode.

Furthermore, the width of the light distribution curve of the first mode, equivalent to the short axis direction of the light distribution curve of the second mode, is bigger compared to the second mode. As such, in the first mode, it is possible to emit bright light over a wide area compared to the second mode.

[Effect]

Next, the effects of lighting apparatus 10 in this embodiment will be described.

As described above, lighting apparatus 10 according to this embodiment includes first light emitting elements 51 and 71 and second light emitting elements 52 and 72 having chromaticity values in the same chromaticity range as first light emitting elements 51 and 71, and control circuit 12 which controls first light emitting elements 51 and 71 and second light emitting elements 52 and 72 separately. Furthermore, first light emitting elements 51 and 71 and second light emitting elements 52 and 72 are dispersedly disposed in predetermined region E. Furthermore, first light emitting elements 51 and 71 are more densely disposed in periphery portion E2 than in center portion E1 in predetermined region E. In addition, second light emitting elements 52 and 72 are more densely disposed in center portion E1 than in periphery portion E2 in predetermined region E.

In this manner, regarding a spectral distribution of combined light which is a combination of the light emitted by first light emitting elements 51 and 71 and the light emitted by second light emitting elements 52 and 72, since a ratio of the greatest value in a range of 500 nm to 560 nm inclusive to the smallest value in a range of 500 nm to 650 nm inclusive, for example, is 0.85 or lower, color perception percentage for old aged people can be increased. Furthermore, with the two types of light emitting elements, first light emitting elements 51 and 71 and second light emitting elements 52 and 72, which have different spectral distributions, illumination suited to old aged people can be performed. As such, it is possible to prevent letters and observed objects from appearing to have lower readability and color saturation to old aged people.

Since first light emitting elements 51 and 71 are more densely disposed in periphery portion E2 than in center portion E1 in predetermined region E, bright light can be emitted over a wide area. Furthermore, since second light emitting elements 52 and 72 are more densely disposed in center portion E1 than in periphery portion E2 in predetermined region E, light having high color rendering property can be emitted to old aged people in the area directly under lighting apparatus 10 and in the vicinity of the area.

Therefore, letters and observed objects from appearing to have lower readability and color saturation to old aged people, and bright light can be emitted over a wide area.

In particular, since first light emitting elements 51 and 71 and second light emitting elements 52 and 72 are dispersedly disposed in predetermined region E, imbalance in the color of emitted light within light emitter 40 can be reduced, and discomfort caused by the illumination light of lighting apparatus 10 can be reduced.

Furthermore, in lighting apparatus 10 according to this embodiment, control circuit 12 includes mode switch 14 for controlling first light emitting elements 51 and 71 and second light emitting elements 52 and 72 separately. Furthermore, control circuit 12 selectively executes a first mode for causing first light emitting elements 51 and 71 to emit light and a second mode for causing first light emitting elements 51 and 71 and second light emitting elements 52 and 72 to emit light. Moreover, control circuit 12 causes brighter light emission when causing light emission in the second mode than when causing light emission in the first mode. In addition, mode switch 14 switches between the first mode and the second mode.

In this manner, since control circuit 12 selectively executes the first mode and the second mode by switching mode switch 14 between the first mode that causes first light emitting elements 51 and 71 to emit light and the second mode that causes second light emitting elements 52 and 72 to emit light, illumination suited to old aged people can be performed. As such, it is possible to prevent letters and observed objects from appearing to have lower readability and color saturation to old aged people.

Furthermore, in lighting apparatus 10 according to this embodiment, combined light of light emitted by first light emitting elements 51 and 71 and light emitted by second light emitting elements 52 and 72 has a correlated color temperature of at least 5500 K and at most 7100 K.

In this manner, since the correlated color temperature of combined light is at least 5700 K and at most 7100 K, it is possible to more reliably prevent letters and observed objects from appearing to have lower readability and color saturation to old aged people.

Furthermore, lighting apparatus 10 according to this embodiment further includes third light emitting elements 53 that emit light having a correlated color temperature of at least 2600 K and at most 5500 K.

In this manner, since the correlated color temperature of the combined light of the light emitted by first light emitting elements 51 and 71 and second light emitting elements 52 and 72 is at least 5500 K and at most 7100 K, and third light emitting elements 53 having a correlated color temperature of at least 2600 K and at most 5500 K are further provided, the color adjustment range of lighting apparatus 10 becomes broad. Accordingly, with lighting apparatus 10, color adjustment from electric lamp color to daylight color can be realized.

Furthermore, in lighting apparatus 10 according to this embodiment, third light emitting elements 53 are dispersedly disposed in predetermined region E. In addition, third light emitting elements 53 are more densely disposed in periphery portion E2 than in center portion E1 in predetermined region E.

In this manner, since third light emitting elements 53 are more densely disposed in periphery portion E2 than in center portion E1 in predetermined region E, light having high color temperature is emitted to an area directly below lighting apparatus 10 and to the vicinity of the area, and light having low color temperature is emitted to the surroundings thereof. Therefore, it is possible to prevent old aged people in the area directly below lighting apparatus 10 or in the vicinity of the area from feeling glare due to illumination in the periphery.

Furthermore, lighting apparatus 10 according to this embodiment further includes lenses 50*d* disposed at positions opposite first light emitting elements 51 and second light emitting elements 52, and lenses 70*d* disposed at positions opposite first light emitting elements 71 and second light emitting elements 72. Furthermore, lighting apparatus 10 according to this embodiment further includes lenses 50*d* disposed at positions opposite third light emitting elements 53. In addition, lenses 70*d* disposed in center portion E1 of predetermined region E have an outer diameter smaller than an outer diameter of lenses 50*d* disposed in periphery portion E2 of predetermined region E.

In this manner, since lenses 70*d* disposed in center portion E1 in predetermined portion E have a smaller external diameter than lenses 50*d* disposed in periphery portion E2 in predetermined portion E, first light emitting elements 51 and 71 and second light emitting elements 52 and 72 can be disposed in high density in center portion E1 compared to periphery portion E2. As such, brighter light can be emitted from center portion E1.

Furthermore, in lighting apparatus 10 according to this embodiment, lenses 70*d* disposed in center portion E1 of predetermined region E have a diffusivity smaller than a diffusivity of lenses 50*d* disposed in periphery portion E2 of predetermined region E.

In this manner, since diffusivity of lenses 70*d* disposed in center portion E1 is smaller than the diffusivity of lenses 50*d* disposed in periphery portion E2, center portion E1 is capable of emitting light of greater intensity compared to periphery portion E2. As such, light having high color rendering property can be emitted to old aged people located in an area directly under lighting apparatus 10 and in the vicinity of the area.

Furthermore, in lighting apparatus 10 according to this embodiment, center portion E1 forms a ring. Furthermore, periphery portion E2 forms a ring and is located on an outer circumference side of center portion E1. In addition, the ratio of width D1, from the inner diameter to the outer diameter of center portion E1, to width D2, from the inner diameter to the outer diameter of periphery portion E2, is from 1:1 to 1:2.

In this manner, if the ratio of the width of the inner circumference portion to the width of center portion E1 is from 1:1 to 1:2, the difference in effect between center portion E1 and periphery portion E2 in lighting apparatus 10 can be further emphasized.

Furthermore, in lighting apparatus 10 according to this embodiment, in the second mode, control circuit 12 causes the output of first light emitting elements 51 disposed in periphery portion E2 of predetermined region E to be lower than in the first mode, and causes the output of second light emitting elements 72 disposed in center portion E1 of predetermined region E to be higher than in the first mode.

In this manner, in the second mode, the output of first light emitting elements 51 disposed in periphery portion E2 made to be lower and the output of second light emitting elements 72 disposed in center portion E1 is made to be higher than in the first mode, and thus a light having a high color temperature can be emitted to an area directly below lighting apparatus 10 and in the vicinity of the area than in the first mode. As such, it is possible to prevent letters and observed objects from appearing to have lower readability and color saturation to old aged people in the area directly below lighting apparatus 10 and in the vicinity of the area.

Furthermore, in lighting apparatus 10 according to this invention, first light emitting elements 51 and 71 emit light having a spectral distribution that includes a first peak wavelength in a range of 425 nm to 480 nm inclusive and a second peak wavelength in a range of 500 nm to 560 nm inclusive. In addition, second light emitting elements 52 and 72 emit light having a spectral distribution that includes a first peak wavelength in a range of 425 nm to 480 nm inclusive, a second peak wavelength in a range of 500 nm to 560 nm inclusive, and a third peak wavelength in a range of 580 nm to 650 nm inclusive.

Furthermore, in lighting apparatus 10 according to this invention, the percentage of second light emitting elements 52 and 72 among first light emitting elements 51 and 71 and second light emitting elements 52 and 72 satisfies at least a 2:1 ratio in number of first light emitting elements 51 and 71 to second light emitting elements 52 and 72.

Furthermore, in lighting apparatus 10 according to this invention, when a relative intensity at a local maximum at the second peak wavelength of the spectral distribution of second light emitting elements 52 and 72 is 1, a relative intensity ratio at a local minimum on a positive side relative to the local maximum is 0.85 or lower.

Furthermore, in lighting apparatus 10 according to this embodiment, light emitted by lighting apparatus 10 in the second mode has a feeling of contrast index (FCI) of at least 93 and at most 120.

Furthermore, in lighting apparatus 10 according to this embodiment, light emitted by lighting apparatus 10 in the second mode has a general color rendering index Ra of at least 86 and at most 100.

Furthermore, in lighting apparatus 10 according to this embodiment, when the percentage of second light emitting elements 52 and 72 among first light emitting elements 51 and 71 and second light emitting elements 52 and 72 satisfies at least a 1:2 ratio in number of first light emitting elements 51 and 71 to second light emitting elements 52 and 72, light emitted by lighting apparatus 10 in the second mode has a chroma value of 2.0 or less, the chroma value being calculated using a calculation method stipulated by CIE 1997 Interim Color Appearance Model (Simple Version).

Furthermore, in lighting apparatus 10 according to this embodiment, third light emitting elements 53 are disposed only in periphery portion E2.

Furthermore, lighting apparatus 10 according to this embodiment further includes third light emitting elements 53. Control circuit 12 includes mode switch 14 for controlling first light emitting elements 51 and 71, second light emitting elements 52 and 72, and third light emitting elements 53 separately; selectively executes a first mode for causing first light emitting elements 51 and 71, second light emitting elements 52 and 72, and third light emitting elements 53 to emit light and a second mode different from the first mode; and causes brighter light emission when causing second light emitting elements 52 and 72 and third light emitting elements 53 to emit light in the second mode than when causing second light emitting elements 52 and 72 and third light emitting elements 53 to emit light in the first mode. In addition, mode switch 14 switches between the first mode and the second mode.

Furthermore, lighting apparatus 10 according to this embodiment includes first light emitting elements 51 and 71; second light emitting elements 52 and 72 having chromaticity values in a same chromaticity range as first light emitting elements 51 and 71; third light emitting elements 53 that emit light having a color temperature lower than a color temperature of light emitted by first light emitting elements 51 and 71 and a color temperature of light emitted by second light emitting elements 52 and 72; and control circuit 12 that controls first light emitting elements 51 and 71, second light emitting elements 52 and 72, and third light emitting elements 53 separately. Furthermore, first light emitting elements 51 and 71, second light emitting elements 52 and 72, and third light emitting elements 53 are dispersedly disposed in predetermined region E. Furthermore, first light emitting elements 51 and 71 are more densely disposed in periphery portion E2 than in center portion E1 of predetermined region E. In addition, second light emitting elements 52 and 72 are more densely disposed in center portion E1 than in periphery portion E2 of predetermined region E. In addition, third light emitting elements 53 are more densely disposed in periphery portion E2 than in center portion E1 of predetermined region E.

Other Embodiments

Although a lighting apparatus according to an exemplary embodiment is described above, the present disclosure is not limited to the foregoing embodiment.

For example, in the foregoing embodiment, in order to achieve age or generation-dependent appropriate amounts of light emitted by the first light emitting elements and the second light emitting elements, the control circuit may store in advance values of current which flow through the first light emitting elements and the second light emitting elements to achieve the appropriate amounts of light corresponding to the age or generation. For example, upon the input of the other external signal, the control circuit obtains an age from the external signal, and reads a value of current which flows through the first light emitting elements for the age or generation and a value of current which flows through the second light emitting elements for the age or generation. By controlling the constant-power output circuit based on the read values of current, the control circuit causes the first light emitting elements and the second light emitting elements to emit light at the amount of light emission for the input age or generation. Accordingly, the first light emitting elements and the second light emitting elements can be caused to emit light at an amount of light emission corresponding to an age or generation, and thus a constant color perception percentage can be secured for any age.

Furthermore, in the foregoing embodiment, the lighting apparatus is not limited to a ceiling light, and may be an integrated-type base light, for example. In this case, by providing the second light emitting elements in a greater density in the center portion of the predetermined region, and providing the first light emitting elements and the third light receiving elements in a greater density in the periphery portion of the predetermined region, it is possible to secure the color perception percentage in the area directly below the lighting apparatus and in the vicinity of the area.

Although one or more aspects of the present disclosure has been described based on the foregoing embodiment, the present disclosure is not limited to the foregoing embodiment. Forms obtained by various modifications to the exemplary embodiment that can be conceived by a person of skill in the art as well as forms realized by combining structural components of different exemplary embodiments, which are within the scope of the essence of the present invention may be included in the scope of the one or more aspects of the disclosure.

What is claimed is:

1. A lighting apparatus, comprising:

first light emitting elements;

second light emitting elements having chromaticity values in a same chromaticity range as the first light emitting elements; and a control circuit that controls the first light emitting elements and the second light emitting elements separately, wherein the first light emitting elements and the second light emitting elements are dispersedly disposed in a predetermined region, the first light emitting elements are more densely disposed in a periphery portion than in a center portion of the predetermined region, and the second light emitting elements are more densely disposed in the center portion than in the periphery portion of the predetermined region.

2. The lighting apparatus according to claim 1, wherein the control circuit:

includes a mode switch for controlling the first light emitting elements and the second light emitting elements separately;

selectively executes a first mode for causing the first light emitting elements to emit light and a second mode for causing the first light emitting elements and the second light emitting elements to emit light; and causes brighter light emission when causing light emission in the second mode than when causing light emission in the first mode, and the mode switch switches between the first mode and the second mode.

3. The lighting apparatus according to claim 2, wherein in the second mode, the control circuit causes output of the first light emitting elements disposed in the periphery portion of the predetermined region to be lower than in the first mode, and causes output of the second light emitting elements disposed in the center portion of the predetermined region to be higher than in the first mode.

4. The lighting apparatus according to claim 2, wherein light emitted by the lighting apparatus in the second mode has a feeling of contrast index (FCI) of at least 93 and at most 120.

5. The lighting apparatus according to claim 2, wherein light emitted by the lighting apparatus in the second mode has a general color rendering index (Ra) of at least 86 and at most 100.

6. The lighting apparatus according to claim 2, wherein when a percentage of the second light emitting elements among the first light emitting elements and the second light emitting elements satisfies at least a 1 to 2 ratio in number of the first light emitting elements to the second light emitting elements, light emitted by the lighting apparatus in the second mode has a chroma value of 2.0 or less, the chroma value being calculated using a calculation method stipulated by CIE 1997 Interim Color Appearance Model (Simple Version).

7. The lighting apparatus according to claim 1, wherein combined light of light emitted by the first light emitting elements and light emitted by the second light emitting elements has a correlated color temperature of at least 5500 K and at most 7100 K.

8. The lighting apparatus according to claim 7, further comprising:

third light emitting elements that emit light having a correlated color temperature of at least 2600 K and at most 5500 K.

9. The lighting apparatus according to claim 8, wherein the third light emitting elements are:

dispersedly disposed in the predetermined region; and more densely disposed in the periphery portion than in the center portion of the predetermined region.

10. The lighting apparatus according to claim 8, further comprising:

lenses disposed at positions opposite the first light emitting elements, the second light emitting elements, and the third light emitting elements, wherein among the lenses, lenses disposed in the center portion of the predetermined region have an outer diameter smaller than an outer diameter of lenses disposed in the periphery portion of the predetermined region.

11. The lighting apparatus according to claim 10, wherein the lenses disposed in the center portion of the predetermined region have a diffusivity smaller than a diffusivity of the lenses disposed in the periphery portion of the predetermined region.

12. The lighting apparatus according to claim 8, wherein the third light emitting elements are disposed only in the periphery portion.

13. The lighting apparatus according to claim 1, wherein the center portion forms a ring, the periphery portion forms a ring and is located on an outer circumference side of the center portion, and a ratio of a width from an inner diameter to an outer diameter of the center portion to a width from an inner diameter to an outer diameter of the periphery portion is from 1:1 to 1:2.

14. The lighting apparatus according to claim 1, wherein the first light emitting elements emit light having a spectral distribution that includes a first peak wavelength in a range of 425 nm to 480 nm inclusive and a second peak wavelength in a range of 500 nm to 560 nm inclusive, and the second light emitting elements emit light having a spectral distribution that includes a first peak wavelength in a range of 425 nm to 480 nm inclusive, a second peak wavelength in a range of 500 nm to 560 nm inclusive, and a third peak wavelength in a range of 580 nm to 650 nm inclusive.

15. The lighting apparatus according to claim 14, wherein when a relative intensity at a local maximum at the second peak wavelength of the spectral distribution of the second light emitting elements is 1, a relative intensity ratio at a local minimum on a positive side relative to the local maximum is 0.85 or lower.

16. The lighting apparatus according to claim 1, wherein a percentage of the second light emitting elements among the first light emitting elements and the second light emitting elements satisfies at least a 2 to 1 ratio in number of the first light emitting elements to the second light emitting elements.

17. The lighting apparatus according to claim 1, further comprising:

third light emitting elements, wherein the control circuit:

includes a mode switch for controlling the first light emitting elements, the second light emitting elements, and the third light emitting elements separately;

selectively executes a first mode for causing the first light emitting elements, the second light emitting elements, and the third light emitting elements to emit light and a second mode different from the first mode; and causes brighter light emission when causing the second light emitting elements and the third light emitting elements to emit light in the second mode than when causing the second light emitting elements and the third light emitting elements to emit light in the first mode, and the mode switch switches between the first mode and the second mode.

18. The lighting apparatus according to claim 1, wherein a spectral distribution of the first light emitting elements is more light emission efficient than the second light emitting elements, and a spectral distribution of the second light emitting elements includes a higher color rendering property than the first light emitting elements.

19. The lighting apparatus according to claim 1, wherein the second light emitting elements are different than the first light emitting elements, the first light emitting elements are disposed in each of the center portion and the periphery portion of the predetermined region, and are each substantially identical, and the second light emitting elements are disposed in each of the center portion and the periphery portion of the predetermined region, and are each substantially identical.

20. A lighting apparatus, comprising:

first light emitting elements;

second light emitting elements having chromaticity values in a same chromaticity range as the first light emitting elements;

third light emitting elements that emit light having a color temperature lower than a color temperature of light emitted by the first light emitting elements and a color temperature of light emitted by the second light emitting elements; and a control circuit that controls the first light emitting elements, the second light emitting elements, and the third light emitting elements separately, wherein the first light emitting elements, the second light emitting elements, and the third light emitting elements are dispersedly disposed in a predetermined region, the first light emitting elements are more densely disposed in a periphery portion than in a center portion of the predetermined region, the second light emitting elements are more densely disposed in the center portion than in the periphery portion of the predetermined region, and the third light emitting elements are more densely disposed in the periphery portion than in the center portion of the predetermined region.

* * * * *